US005255639A

United States Patent [19]

Shirey et al.

[11] Patent Number: 5,255,639

[45] Date of Patent: Oct. 26, 1993

[54] INTEGRAL EVT/CYLINDER HEAD ASSEMBLY WITH SELF-PURGING FLUID FLOW

[75] Inventors: Benjamin G. Shirey, Holly; Martin A. Holland, Auburn Hills, both of Mich.

[73] Assignee: Siemens Automotive L.P., Auburn Hills, Mich.

[21] Appl. No.: 961,609

[22] Filed: Oct. 15, 1992

[51] Int. Cl.[5] ..... F01L 1/34

[52] U.S. Cl. ..... 123/90.16; 123/90.12

[58] Field of Search ..... 123/90.12, 90.13, 90.15, 123/90.16, 90.48, 90.49, 90.55

[56] References Cited

U.S. PATENT DOCUMENTS

| | | | |
|---|---|---|---|
| 2,948,274 | 8/1960 | Wood | 123/90.16 |
| 3,439,661 | 4/1969 | Weiler | 123/90.16 |
| 3,490,423 | 1/1970 | Shunta et al. | 123/90.16 |
| 4,164,917 | 8/1979 | Glasson | 123/90.16 |
| 4,466,390 | 8/1984 | Babitzka et al. | 123/90.12 |
| 4,615,306 | 10/1986 | Wakeman | 123/90.16 |
| 4,671,221 | 6/1987 | Geringer et al. | 123/90.16 |
| 4,674,451 | 6/1987 | Rembold et al. | 123/90.16 |
| 4,696,265 | 9/1987 | Nohira | 123/90.16 |
| 4,796,573 | 1/1989 | Wakeman et al. | 123/90.16 |
| 4,917,056 | 4/1990 | Yagi et al. | 123/90.16 |
| 5,005,540 | 4/1991 | Watanabe | 123/90.12 |
| 5,119,774 | 6/1992 | Krieg et al. | 123/90.55 |
| 5,129,374 | 7/1992 | Flavio | 123/90.55 |
| 5,158,048 | 10/1992 | Robnett et al. | 123/90.16 |

FOREIGN PATENT DOCUMENTS

| | | | |
|---|---|---|---|
| 27949 | 5/1981 | European Pat. Off. | 123/90.12 |
| 2032005 | 4/1980 | United Kingdom | 123/90.12 |

*Primary Examiner*—Willis R. Wolfe
*Assistant Examiner*—Weilun Lo
*Attorney, Agent, or Firm*—Russel C. Wells; George L. Boller

[57] ABSTRACT

A structure for mounting electronic valve timing control system components wherein any bubbles or other air carrying obstructions are purged from the system. The inlet and outlet passageways (14, 18) to and from the actuator (16) are displaced either a predetermined vertical distance ("H") or are in-line and inclined along the same passageway axis.

1 Claim, 1 Drawing Sheet

INTEGRAL EVT/CYLINDER HEAD ASSEMBLY WITH SELF-PURGING FLUID FLOW

This invention relates to electronic valve timing actuators in general and more particularly to structure for purging the system of air entrained in the fluid supply to the valve.

BACKGROUND OF THE INVENTION

U.S. Pat. No. 5,119,774, entitled "Direct Acting Hydraulic Valve Lifter" issued on Jun. 9, 1992 by Krieg et al., describes a direct acting hydraulic valve lifter (DAHVL) having various features which individually and/or in combination may provide reduced reciprocating mass with lower oil loss in operation, faster filling of the lifter after draining and more positive discharge of air from the lifter. Vent means from the oil chambers between the hydraulic element assembly and the follower cylinder supporting it provide for the passage of air within the DAHVL.

U.S. Pat. No. 5,129,374, entitled "Hydraulic Tappet", issued on Jul. 14, 1992 by Flavio, provides structure within the tappet which causes the oil to traverse a 360° circular path and through two vertical levels in flowing from the inlet to the inner reservoir within the tappet.

U.S. Pat. No. 4,615,306, entitled "Engine Valve Timing Control System" issued on Oct. 7, 1986 by Wakeman and assigned to a common assignee, describes a system using electrohydraulic valve lifters operatively connected to an ECU to provide real time changes in engine valve timing. Pressure pulses within the system, operate to "home" the lifters to the base circle of the timing cams. The ECU controls a solenoid which controls the passage of fluid to and from the lifters.

U.S. Pat. No. 5,005,540, entitled "Valve Timing Control System for an Internal Combustion Engine", issued on Apr. 9, 1991 by Watanabe, teaches a DAHVL utilizing two pistons and the ratio of their respective areas to multiply the lift of the timing cam to open the engine valve the desired amount. Fluid is supplied and removed by passageways that are both horizontal and inline.

SUMMARY OF THE INVENTION

When dealing with hydraulic fluids in a closed system, the fluid generates air bubbles which function to displace fluid. In an electronic timing system, such air bubbles must be removed and in order to accomplish this, the inlet means in the housing is positioned lower than the outlet means. The air bubbles flow from the pump means through the housing to the outlet means and the solenoid valve means to purge the hydraulic actuator of unwanted air.

In order to solve such a problem, the preferred embodiment of an electronic valve timing control system has an hydraulic actuator mounted in a bore in the cylinder head of an internal combustion engine. The actuator is coupled between a timing cam and an engine valve. The housing of the actuator has at least one inlet means for receiving hydraulic fluid from a source of hydraulic fluid by means of a pump operatively coupled to the source of fluid. The housing also has an outlet means for discharging hydraulic fluid under control of a solenoid valve means to the source of the hydraulic fluid. An electronic control unit responding to various sensed engine parameters controls the solenoid valve means.

A first passageway has its inlet coupled to the pump means including one way valve means and its outlet coupled to the inlet means of the housing. The first passageway supplies the fluid to the inlet means of the housing.

A second passageway has its inlet coupled to the outlet means of the housing and directs the flow of discharged fluid from the actuator through the solenoid valve means to the source of hydraulic fluid. The inlet of the second passageway is parallel to and displaced a predetermine height above the outlet of the first passageway.

In another embodiment of the electronic valve timing control system the second passageway has its inlet displaced from the outlet of the first passageway.

In still another embodiment of the electronic valve timing control system, the inlet of the second passageway is inclined to the outlet of the first passageway.

In still another embodiment of the electronic valve timing control system, the second passageway is inline with and inclined to the first passageway and the inlet of the second passageway is displaced downstream from the outlet of the first passageway.

In yet another embodiment of the electronic valve timing control system the inlet of the second passageway is elevated above the outlet of the first passageway.

DETAILED DESCRIPTION

Figure 1:
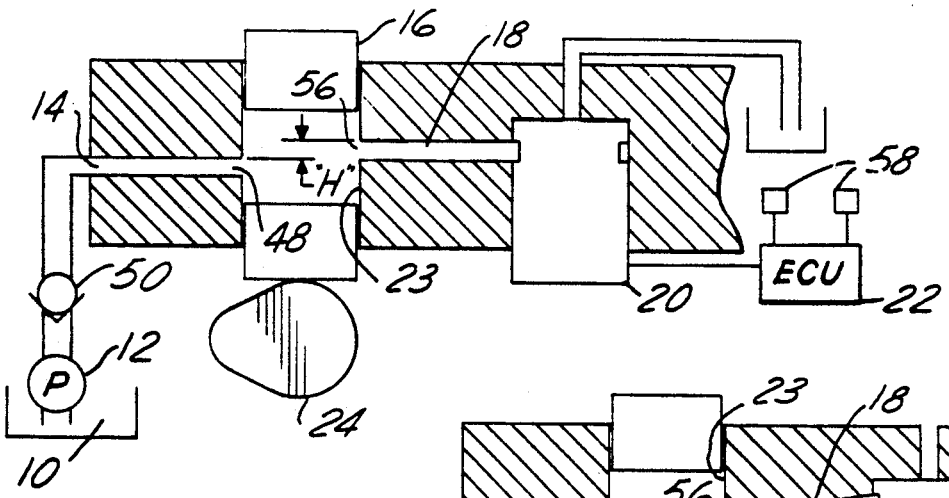
FIG. 1 is a schematic of an electronic valve timing system incorporating air purge of the fluid.
Figure 2:
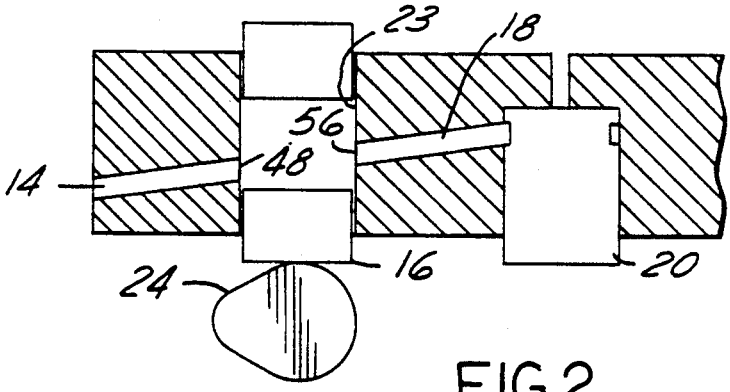
FIG. 2 is a schematic of an alternate embodiment of the electronic valve timing system incorporating air purge of the fluid.

The systems of FIG. 1 and FIG. 2 have a source of hydraulic fluid 10, a pump means 12 operatively connected to the source, a first passageway 14 from the pump means 12, an hydraulic actuator 16, a second passageway 18 from the hydraulic actuator, a solenoid control valve 20 and an electronic control unit 22.

Figure 3:
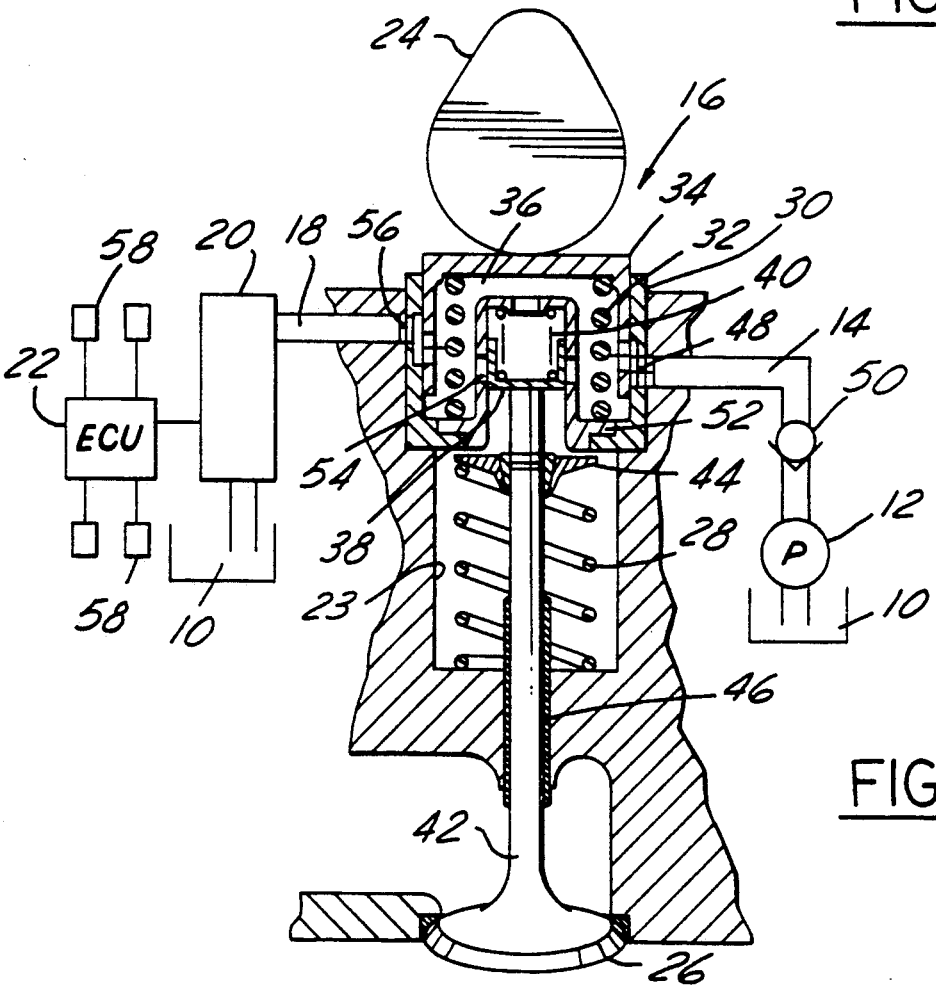
FIG. 3 is a sectional view of an hydraulic actuator as maybe used in the electronic valve timing system of FIG. 1.

Referring to FIG. 3, there is illustrated in section view an embodiment of a direct acting hydraulic valve lifter, DAHVL, actuator 16 for use in a bore 23 in the cylinder head of an internal combustion engine. An example of a DAHVL is found in the copending patent application entitled "Dual bucket Hydraulic Actuator by Taxon which is filed concurrently herewith having U.S. Ser. No. 07/961,610, now U.S. Pat. No. 5,216,988, and assigned to a common assignee. The actuator 16 is positioned between a timing cam 24 and an engine valve 26 in the engine block or cylinder head of the engine. A valve spring 28 is operatively connected to the engine valve 26 for biasing the engine valve closed.

The actuator 16 has a tubular housing member 30, and a first bias spring 32, a first piston 34 having a bucket shape forming an inner chamber 36. The first piston 34 is mounted for reciprocal motion in the housing member 30 under control of the timing cam 24 and biased toward the timing cam by the first bias spring 32.

In addition, there is a second piston 38 having a bucket shape forming an inner chamber 40. The second piston is operatively coupled to the engine valve through an elongated valve stem 42. The second piston is mounted for reciprocal motion to open and close the engine valve 26. The valve spring 28 is mounted between the bottom of the enclosed bore 23 and a spring retainer bracket 44 mounted on the valve stem 42 at a point intermediate the ends of the stem. The valve stem 42 is slideably located in a guide means 46 in the cylinder head. In the present embodiment, the cylinder head maybe be part of the engine block, a special valve cover or other member that is secured to the engine.

At least one inlet means 48 is shown extending through the housing 30 for receiving the hydraulic fluid from the first passageway 14. The first passageway 14 is connected through a one-way valve 50 to the pump means 12. The pump means 12 operates in a conventional manner to pump the hydraulic fluid from its source to the actuator 16.

Mounted coaxial with the first piston 34 in the housing is a tubular piston guide means 52. The function of the tubular piston guide means is to reciprocally guide the second piston 38 along the inner surface of the guide means 52.

Intermediate the ends of the piston guide means 52 is at least one communication port 54 extending through the wall of the guide means. It is the function of this communication port 54 to connect the inner chambers 36,40 of the first and second pistons 34,38 for aiding the flow of hydraulic fluid.

The tubular housing member 30 has at least one outlet means 56 through its wall for discharging hydraulic fluid from the housing member 30. As illustrated in FIG. 1, the first passageway 14 from the pump means 12 enters the housing 30 at a point which is spaced a predetermined distance "H" below the second passageway 18 from the outlet means 56. This allows for the passage of any air bubbles or other fluid characteristics which substitutes air for fluid.

In the embodiment shown in FIG. 1, the first or inlet passageway 14 and the second or outlet passageway 18 are parallel to each other, but the outlet passageway is spaced the predetermined distance "H" above the inlet passageway 14.

An alternative embodiment as illustrated in FIG. 2 would have both the first and second passageways 14,18 inline but inclined to the centerline of the actuator 16 with the first or inlet passageway 14 being downhill from the second or outlet passageway 18.

A solenoid valve means 20 operates to control the discharge of the hydraulic fluid from the actuator 16 to the source of hydraulic fluid 10. The solenoid valve 20 is an electromagnetically controlled valve which is controlled by an electronic control unit 22 which is responsive to various sensed engine parameters 58. These parameters 58 define when the engine valve 26 should be opened and closed for best engine operation.

There has thus been illustrated and described an electronic valve timing system for electronically controlling the timing of the operation of the engine valves in an internal combustion system utilizing means for purging the system of air entrained bubbles in the hydraulic fluid.

What is claimed is:

1. An electronic valve timing control system having an hydraulic actuator having a housing mounted in a bore in the cylinder head of an internal combustion engine and coupled between a timing cam and an engine valve, a source of hydraulic fluid, at least one inlet means through the housing for receiving hydraulic fluid, a pump operatively coupled to the source of fluid for pumping fluid to the inlet means, an outlet means through the housing for discharging the fluid, a solenoid valve means for controlling the discharge of the fluid from the housing to the source of the fluid, an electronic control unit responding to various engine parameters for controlling the solenoid valve means the system characterized in that:

a first passageway having its inlet coupled to the pump means and its outlet coupled to the at least one inlet means, said first passageway supplying the fluid to the inlet means;

a second passageway having its inlet coupled to the outlet means for directing the flow of discharged fluid from the actuator and its outlet coupled to the source of hydraulic fluid;

said second passageway is inline with said first passageway and said inlet of said second passageway is displaced from and elevated above said outlet of said first passageway.

* * * * *